US008424543B2

(12) United States Patent
Lombardi et al.

(10) Patent No.: US 8,424,543 B2
(45) Date of Patent: Apr. 23, 2013

(54) RED LIGHT EMITTING DEVICE FOR USE WITH HAIR PRODUCT AND BLOW DRYER

(75) Inventors: Jack Lombardi, Massapequa, NY (US); Vasile Ionita-Manzatu, Old Bethpage, NY (US)

(73) Assignee: ELC Management LLC, New York, NY (US)

( * ) Notice: Subject to any disclaimer, the term of this patent is extended or adjusted under 35 U.S.C. 154(b) by 63 days.

(21) Appl. No.: 13/161,083

(22) Filed: Jun. 15, 2011

(65) Prior Publication Data

US 2012/0145178 A1 Jun. 14, 2012

Related U.S. Application Data

(60) Provisional application No. 61/360,085, filed on Jun. 30, 2010.

(51) Int. Cl.
*A45D 20/08* (2006.01)

(52) U.S. Cl.
USPC ..... 132/271; 132/210

(58) Field of Classification Search ..... 132/271, 132/200, 202–211
See application file for complete search history.

(56) References Cited

U.S. PATENT DOCUMENTS

| | | | |
|---|---|---|---|
| 3,289,679 | A | 12/1966 | Zellerman |
| 4,263,500 | A | 4/1981 | Springer et al. |
| 4,323,761 | A | 4/1982 | Hubner |
| 5,395,490 | A | 3/1995 | Hoff et al. |
| 5,761,824 | A | 6/1998 | Moon et al. |
| 5,858,179 | A | 1/1999 | Loda |
| 6,026,821 | A | 2/2000 | Last |
| 6,205,674 | B1 | 3/2001 | Kaizuka |
| 6,205,677 | B1 | 3/2001 | Yune |
| 6,285,828 | B1 | 9/2001 | Cafaro |
| 6,363,215 | B1 | 3/2002 | Cafaro |
| 6,378,225 | B1 | 4/2002 | Slingo |
| 6,389,710 | B1 | 5/2002 | Chou |
| 6,481,116 | B1 | 11/2002 | Slingo |
| 6,651,674 | B2 | 11/2003 | Ozaki et al. |
| 6,763,606 | B2 | 7/2004 | Saida |
| 6,798,982 | B2 | 9/2004 | Ryu et al. |
| 6,941,675 | B2 | 9/2005 | Slingo |
| 7,228,065 | B2 | 6/2007 | Cafaro |
| 7,428,785 | B2 | 9/2008 | Kim |
| 2001/0005943 | A1 | 7/2001 | Fukumoto et al. |
| 2004/0159002 | A1 | 8/2004 | Carlucci et al. |
| 2005/0229424 | A1 | 10/2005 | Hur |
| 2007/0033825 | A1 | 2/2007 | Lo et al. |

(Continued)

FOREIGN PATENT DOCUMENTS

| | | |
|---|---|---|
| CA | 2 557 429 | 2/2007 |
| CN | 201022454 | 2/2008 |

(Continued)

OTHER PUBLICATIONS

PCT International Search Report; International Application No. PCT/US2011/040621; Completion Date: Feb. 24, 2012; Date of Mailing: Feb. 27, 2012.

(Continued)

*Primary Examiner* — Rachel Steitz
(74) *Attorney, Agent, or Firm* — Peter Giancana

(57) ABSTRACT

A red light emitting device for use with a hair product and a blow dryer. The device with composition is suitable for permanently reshaping human hair by non-chemical means.

5 Claims, 3 Drawing Sheets

U.S. PATENT DOCUMENTS

| | | | |
|---|---|---|---|
| 2008/0201979 | A1 | 8/2008 | Rhoades |
| 2008/0240690 | A1 | 10/2008 | Ono et al. |
| 2009/0000141 | A1 | 1/2009 | Gross et al. |

FOREIGN PATENT DOCUMENTS

| | | |
|---|---|---|
| DE | 4238456 | 5/1994 |
| DE | 4238457 | 5/1994 |
| DE | 9320970 | 10/1995 |
| EP | 0329864 | 8/1989 |
| EP | 1688060 | 8/2006 |
| EP | 1898740 | 3/2008 |
| EP | 1898741 | 3/2008 |
| JP | 2000189231 | 7/2000 |
| JP | 2002034639 | 2/2002 |
| JP | 2004012122 | 1/2004 |
| TW | 265013 | 11/2006 |
| WO | 0045777 | 8/2000 |
| WO | 2007043732 | 4/2007 |
| WO | 2007058434 | 5/2007 |

OTHER PUBLICATIONS

PCT Written Opinion of the International Searching Authority, or the Declaration; International Application No. PCT/US2011/040621; Completion Date: Feb. 24, 2012; Date of mailing: Feb. 27, 2012.

RED LIGHT EMITTING DEVICE FOR USE WITH HAIR PRODUCT AND BLOW DRYER

This application clams priority to U.S. 61/360,085, filed Jun. 30, 2010.

FIELD OF THE INVENTION

The invention is in the field of hair styling. More particularly, the invention concerns permanent hair shaping by non-chemical means, and improvements in hair drying and styling.

BACKGROUND OF THE INVENTION

PCT/US10/24641 (herein incorporated by reference, in its entirety) discloses topical hair compositions that comprise materials that, when activated, emit electromagnetic radiation at wavelengths that affect tertiary structure (i.e. breaking of disulfide bonds) in human hair, and that bring about changes in secondary structure of hair proteins. The intensity of the radiation emitted by the activated materials is controlled and sufficient to cause or facilitate altering of protein structure. Compositions comprising such materials are useful for hair reshaping or styling. Testing indicates that the hair reshaping is permanent and that there is no damage to hair of the type characteristic of chemical treatments. Preferred materials must be activated before they will emit electromagnetic radiation at wavelengths that affect protein structures in human hair. Preferred materials are tourmalines.

PCT/US10/24641 also discloses that tourmaline may be activated by irradiating it with visible light, however, heating the tourmaline above a certain minimum temperature is a preferred method of activation. A preferred method of heating is with a hair dryer, such as a handheld blow dryer commonly used in homes, or a full-surround hair dryer commonly seen in salons. When using the heating method of activation, a minimum activation temperature of 40° C. is useful to prevent unwanted activation of the tourmaline. Temperatures above 80° C. can be used to activate the tourmaline, but the temperature itself begins to have a detrimental effect on the hair. Therefore, it is disclosed in '641 that the most preferred activation temperatures are between about 60° C. and 80° C. These temperatures are achievable with a handheld hair dryer, even though the source of hot air may be several inches from the hair and the hot air flow may not be continuously directed on the same portion of hair. Preferably, activation is achievable within ten minutes of blow drying, more preferably, within five minutes of blow drying, most preferably, within one minute of blow drying.

PCT/US10/24641 also discloses that when light is used to achieve activation, shining a visible light (red, blue, green etc) on the inactivated material (i.e. tourmaline) causes the material to radiate in the 0.15 to 30 μm wavelength range. The intensity of the emitted radiation, in general, depends on the intensity of the visible light activation source. Deactivation is achieved by removing the visible light source. It is reported that activation and deactivation by this method would be essentially immediate, since there is no waiting for the suitable material to heat up.

The present specification describes a device that optimizes heat energy and light energy together, to achieve activation of one or more materials that are capable of emitting electromagnetic radiation at wavelengths that affect protein structures of human hair.

OBJECTS OF THE INVENTION

A main object of some embodiments of the invention is to provide a device that activates an inactivated hair shaping topical composition at low temperatures.

Another object of some embodiments of the invention is to provide a device that improves the efficiency of hair shaping topical compositions, especially at temperatures below 60° C.

Another object of some embodiments of the invention is to provide a device that combines heat energy and light energy to achieve activation of one or more materials that are capable of emitting electromagnetic radiation at wavelengths that affect protein structures of human hair.

SUMMARY

A device that combines heat energy (in the form of a column of hot air) and light energy (in the form of visible light), to achieve activation of one or more materials that are capable of emitting electromagnetic radiation at wavelengths that affect protein structures of human hair. The device is capable of emitting a columnar flow of hot air and visible light. In use, the hot air flow and a concentrated spot of the visible light impinge a swatch of hair being treated, such that the concentrated spot of light is confined within the column of hot air flow. The use of heat and light together leads to efficient permanent hair reshaping, at lower temperatures.

DETAILED DESCRIPTION

Figure 1:
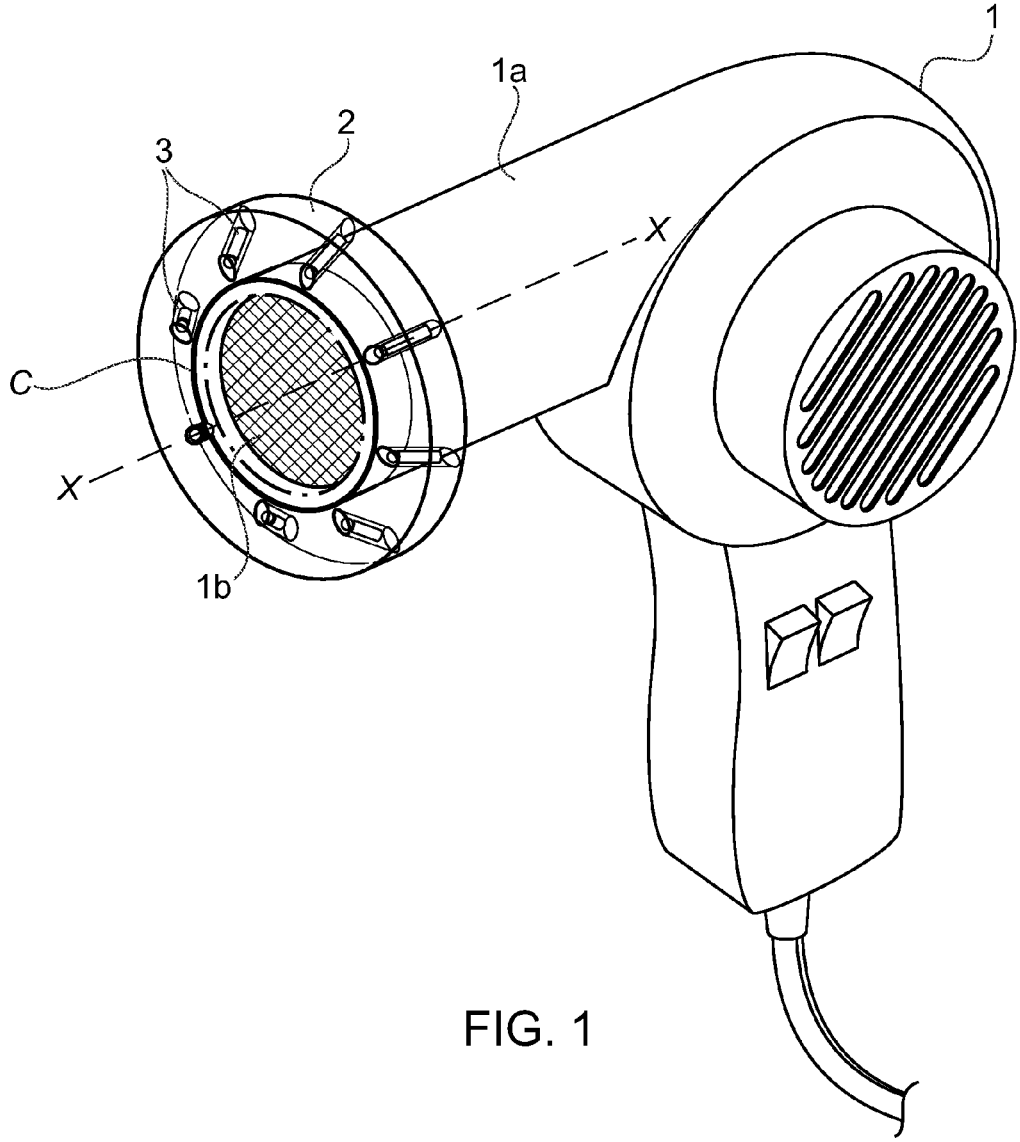
FIG. 1 is a perspective view of a red light emitting device mounted on a blow dryer.
Figure 2:
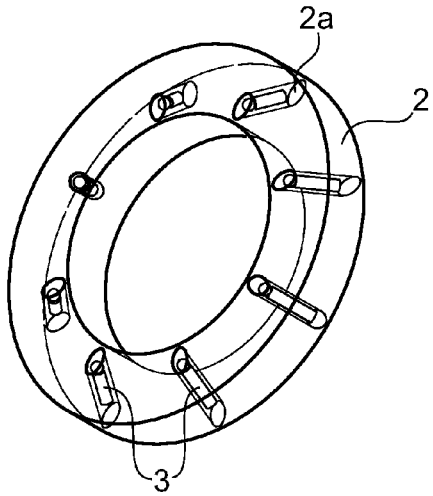
FIG. 2 is a perspective view of a red light emitting device for use with a blow dryer.
Figure 3:
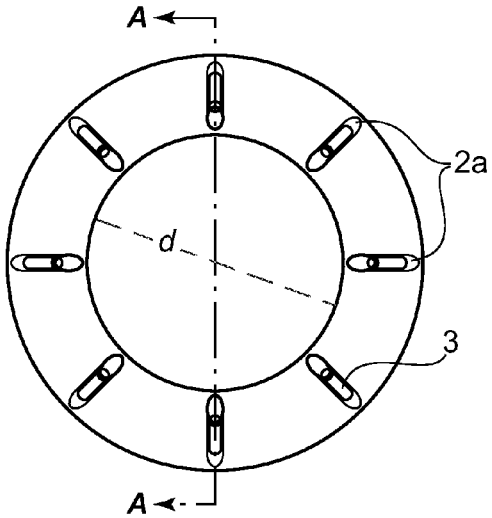
FIG. 3 is an elevation view of a red light emitting device having 8 light sources, for use with a blow dryer.
Figure 4:
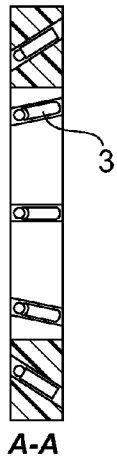
FIG. 4 is a cross section through line A-A of FIG. 3.

Throughout the specification, "comprise" means that an element or group of elements is not automatically limited to those elements specifically recited, and may or may not include additional elements.

A device according to one embodiment of the present invention comprises a means of directing a heated air flow and a means of directing light at a swatch of hair that is being treated or styled. The device includes an exit orifice that emits a well defined columnar air flow toward the surface of the swatch of hair. The distance from the exit orifice to the hair surface is characterized by a parameter, L. For example, since a swatch of hair being treated may have tens or hundreds of individual strands of hair, L may be some average distance from the swatch to the exit orifice. The device also includes one or more sources of light. When the exit orifice of the device is located at the distance L from the hair swatch, then the light from the one or more sources is directed into a well defined concentrated spot on the surface of the swatch. The arrangement of the device is such that the spot of light is approximately concentric with the columnar air flow. Depending on the number and location of light sources, and depending on the angle at which the device is held in relation to the surface of the hair swatch, the concentrated spot of light shining on the hair swatch may be a circular or non-circular elliptical. In either case, the lights are arranged such that the concentrated spot of light is contained within the columnar air flow. The light source itself, may be in the columnar air flow or out of it, but the spot of light that appears on the hair surface is confined within the columnar air flow.

In one embodiment, a convenient means of creating a columnar flow of hot air is with a handheld hair dryer (1) having an elongated columnar nozzle (1*a*). Thus, a first part of a device according to the present embodiment is a nozzle that comprises an exit orifice (1*b*) from which emerges a heated air flow. The outer diameter of the columnar nozzle may typically be about 2.5 cm to about 10 cm. Generally, handheld hair dryers have a selection switch that allows the user to choose a temperature of the hot air. For example, a three position switch may offer low, medium and high, which may correspond to 40° C., 60° C. and 80° C., respectively. A device according to the present embodiment may also have such a selection switch, but the device of the present invention is capable of creating a columnar air flow having a temperature of about 40° C. to about 60° C.; more preferably from about 40° C. to about 50° C.; most preferably from about 40° C. to about 45° C. In typical use, the exit orifice (1*b*) of the nozzle (1*a*) of a device (1) according to the present embodiment may be held a distance from the swatch of hair being treated. As discussed above, this distance is characterized by a parameter, L. In the present embodiment, L is from about 2.0 cm to about 20 cm. The hot air emerging from the exit orifice travels this distance and impinges the swatch of hair being treated, heating the inactivated material previously deposited on the hair.

As noted above, the device also includes one or more sources of light (3). In order to concentrate the light into a well defined spot that is approximately concentric with the columnar air flow, a single light source may be located on a central axis, X, of the air column. Alternatively, if one or more light sources are located off the central axis of the air column, then the light must be directed toward the axis, and intersect the axis at the defined distance L, from the exit orifice (1*b*).

In one preferred embodiment of the device, the one or more light sources are located off the central axis, X, of the columnar air flow, and outside of the columnar air flow. For example, if the device has the form of a handheld hot air hair dryer, then the one or more light sources (3) may be located outside the circumference, C, that defines the end of the nozzle (1*a*) of the hair dryer. But in that case, the light sources are directed to a location on the central axis of the nozzle that is a distance L from the exit orifice (1*b*) of the nozzle. In this embodiment, multiple light sources are arrayed around the nozzle, near the end of the nozzle. The light sources are oriented so that each beam of light meets on the axis of the air column, and distance L from the exit orifice of the nozzle. In order to maintain this arrangement, the light sources are set in a fixed array.

Figure 5:
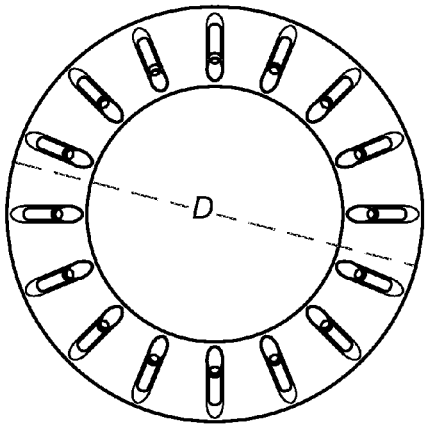
FIG. 5 is an elevation view of a red light emitting device having 16 light sources, for use with a blow dryer.

One embodiment of a fixed array of light sources is shown in FIGS. 2-5. The light sources are set inside a collar (2). In one embodiment of the collar shown in the figures, the collar is a solid ring, characterized by an inner diameter, d and an outer diameter, D. The inner diameter is sufficiently large to allow a portion of the nozzle (1*a*) to pass into the collar. The collar may be maintained near the exit orifice (1*b*) of the nozzle, by any suitable means, including: a friction fit or snap fit of the nozzle against the inner diameter of the collar, adhesive or mechanical fastener. The collar may be permanently mounted to the nozzle or it may be possible to position the collar on the nozzle and remove it from the nozzle repeatedly. The outer diameter and thickness of the collar are large enough to allow the placement of several light sources, or portions thereof, inside the collar. In some embodiments, the solid collar (2) is provided with an array of channels (2*a*). All or some of the channels house a light source. For example, in FIGS. 2-4, the solid collar has eight channels that pass through, from one flat face of the solid collar to the other. Each channel accommodates a light source. In FIG. 5, sixteen channels and sixteen light sources are shown. The number of light sources can be chosen as needed to effect the results described below.

Figure 6:
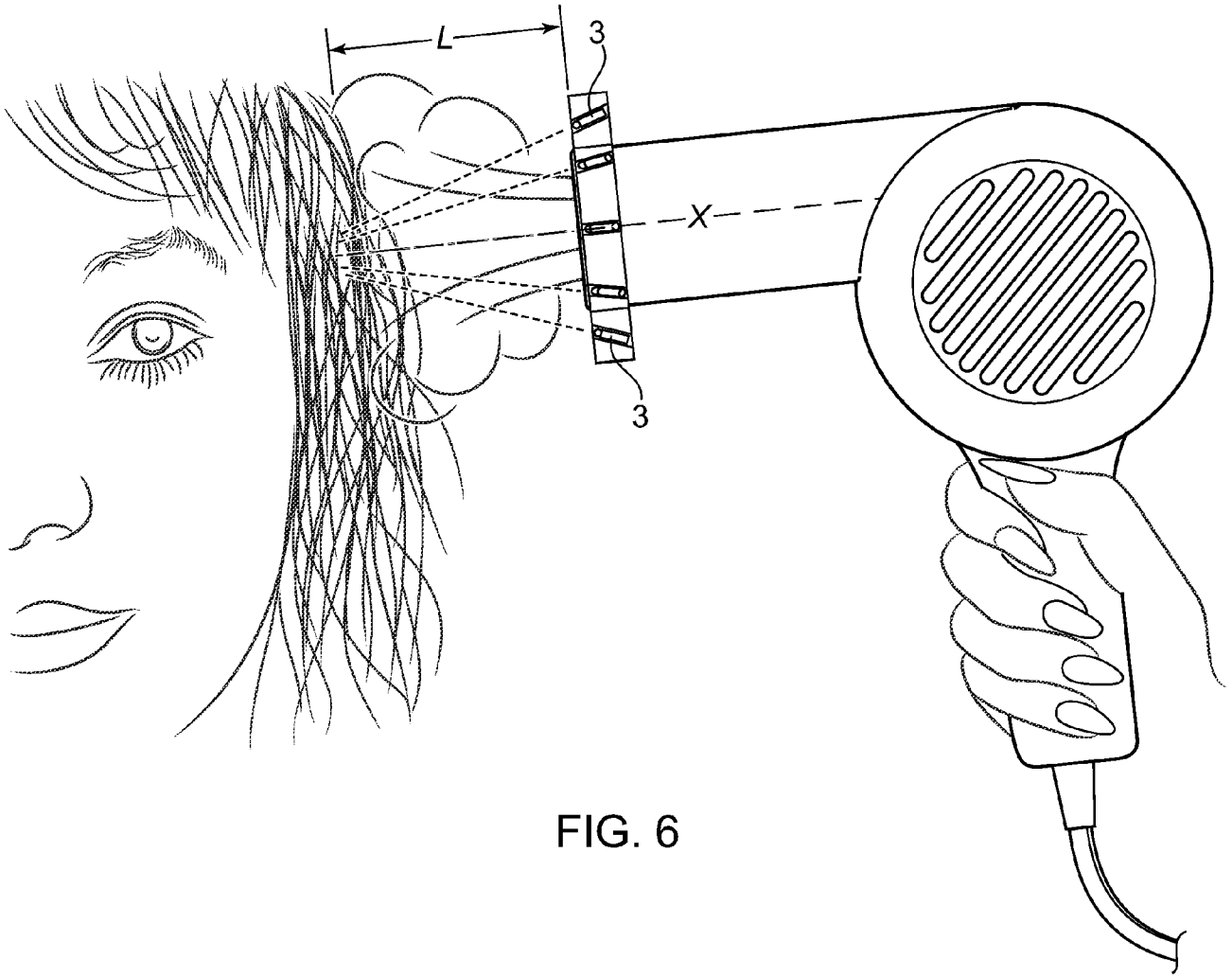
FIG. 6 depicts the use of a red light emitting device mounted on a blow dryer, showing the red light concentrated within the column of air flow.

As the figures show, the channels (2*a*) are oriented at an angle to the central axis, X. Consequently, as FIG. 6 shows, the light sources are directed toward the central axis, X, of the blow dryer nozzle (1*a*). The individual light beams converge on or near central axis X, at the defined distance L, from the exit orifice (1*b*), where, in use, hair will be located. Importantly, the convergence of the light sources on the hair, is within the columnar air flow of the blow dryer, so that a swatch of hair is treated by heat and light simultaneously. This is unlike some blow dryers that incorporate sources of light. For example, US 2009/0000141 discloses a hair dryer with light sources that provide visible light into a work area. However, the '141 reference does not disclose the light sources that converge near the central axis, in the columnar air flow. Rather, the lighting is diffused over a wide area to improve visibility in a work area.

It will be readily apparent, that the light sources (3) of the present invention cannot be disposed just anywhere along the nozzle (1*a*). Rather, the light sources must be sufficiently close to the end of the nozzle, so that the nozzle does not block the path of the light emanating from the light sources and propagating toward the central axis. This is unlike the some blow dryers that incorporate light sources. For example, the '141 reference discloses a fixed array of light sources arrayed around the nozzle of a hair dryer. However, the light sources in the '141 reference are not near the end of the nozzle. Thus, even if the light sources were oriented for the light to converge at a distance L from the exit orifice of the hair dryer, the light would be blocked by the nozzle.

Any suitable material may be used for the collar (2), but molded plastic is especially preferred. The collar may be transparent or opaque. Though we have described a fixed array of light sources as a solid ring, the array may be achieved by any suitable means consistent with the needs and principles defined herein. Any other means of maintaining a fixed array of light sources, such that the light converges on the central axis of the columnar air flow, may be useful. For example, the array or light sources may be set in a collar of some other shape, a portion of which is complimentary to the shape of a blow dryer nozzle. In general, the fixed array of light sources may be separate from or integral with the blow dryer with which it will be used.

In addition to a light source, each channel may house components related to the positioning, retention and/or operation of the light sources. For example, a channel may have a lamp holder that has been in-molded or otherwise fastened into the channel. The lamp holder is ready to receive a light source. The collar may also house components related to the operation of the light sources. For example, electric conductors (not shown in the drawings) that connect all of the light sources into an electrical array, may be housed within the collar. Alternatively, a set of electric leads may extend from each light source, out the back of each channel, so that these leads can be connected to a power source and/or to each other.

The fixed array of light sources may have its own power supply or tap into a power supply of the blow dryer. Where the fixed array is separate from the blow dryer, it may be necessary to have a separate power source for the fixed array. In this case, the fixed array of light sources may include an electrical conductor for tapping a power source. For example, all of the light source in the array may have electrical leads that are fed by a single electrical power cord that is plugged into an electrical outlet of the type commonly found in houses. Where the fixed array is integral with a blow dryer, all of the light source in the array may have electrical leads that are fed from the same power cord as the blow dryer.

As we have said, at the surface of a swatch of hair being treated, the concentrated spot of light is contained within the columnar air flow. The light sources must be such that a well defined spot of concentrated light appears on the swatch of hair. A generalized, diffuse light will be much less effective or ineffective. Of course, light sources radiate in all directions, so there will be some light that falls outside of the columnar air flow. What is important is that at the hair surface, there is a well defined, concentrated spot of light significantly brighter than the rest of the field. What is ultimately important is that at the hair surface there is a spot of light whose intensity is sufficient to activate the one or more materials, and that this activation take place efficiently. Light falling outside of the concentrated spot, and outside of the columnar air flow, may not meet these criterion. By "efficiently", we mean that the intensity of concentrated spot is sufficient to activate an amount of material to emit electromagnetic radiation at an intensity that makes hair reshaping possible, in a commercially acceptable amount of time. By "commercially acceptable amount of time" we mean less than about one hour, more preferably, less than about 30 minutes, more preferably still, less than about 10 minutes, most preferably less than about 5 minutes. With the teachings of this specification, a person of ordinary skill in the art can determine a minimum intensity of the concentrated spot that, when combined with a heated columnar air flow, leads to an intensity from the activated materials that makes hair reshaping possible, in a commercially acceptable amount of time. So, if an otherwise useful light source (i.e. one having the right wavelength to activate the inactivated material) leads to an unacceptably long time to effect the desired change in hair (3 hours, for example), then that light source is less suitable or not at all suitable for use in the present invention, because such a device has low commercial viability. Faced with this outcome, a person of ordinary skill in the art would know, upon reading this specification, that the intensity of the concentrated spot must be increased.

In one preferred embodiment, the lights sources (3) are directional. That is, they emit a substantial portion of their energy in a preferential direction or in a defined angular pattern. In some embodiments, at least 25% of each light source's power output is directed toward the concentrated spot, within the columnar air flow. More preferred is at least 50% of each light source's power output, and more preferred still is at least 75% of each light source's power output. Suitable light sources include those that emit their energy in a cone shape. In various embodiments, the apex of the cone has an angle of 15° to 90°. For example, 60° to 90° or 30° to 90°. In one useful embodiment, 50%-60% of the light source's power output is directed into cone with an apex of 15° to 60°; more preferably 15° to 30°. Light emitting diodes (LEDs) that are designed to radiate a significant portion of their output energy into a defined angular cone are commercially available, and may be suitable for this purpose. Other suitable light sources include lasers.

In the present invention, the light from the light sources (3) includes visible red light, and possibly near infrared. By visible red light, we mean light having a peak wavelength in the range of about 600 nm to 750 nm. By near infrared light we mean light having a peak wavelength in the range of about 750 nm to about 1,400 nm. Humans, at normal body temperature, radiate most strongly in a range centered around 10,000 nm, and the low end of that range gets closer and closer to near infrared. For this reason, it is preferable if the inactivated material that is to be activated by the light sources (3), is not significantly activated by light near 10,000 nm wavelength. Otherwise, the inactivated material would be inappropriately activated by thermal radiation emanating from the skin. More preferably, and for the same reason, the inactivated material is not significantly activated by light above about 1,400 nm wavelength. In one particularly useful embodiment, 50%-60% of the light sources power output is directed into cone with an apex of 15° to 60°; more preferably 15° to 30°, and the peak wavelength of light is between about 600 nm and 1400 nm.

Compositions Comprising an Inactivated Material

The combination light source array-blow dryer device that we have described up to now, is intended for use with one or more in activated materials (or with a composition containing one or more materials) that are capable of emitting electromagnetic radiation at wavelengths that affect protein structures of the hair. Thus, prior to use, the individual strands of the swatch are already in close proximity to one or more of these materials in an inactivated form or state. Close proximity means within 5.0 cm of the surface of a strand, more preferably within 2.5 cm of the strand surface, most preferably in direct physical contact with the strand surface. When a column of heated air and a light of specified wavelength and intensity impinges a portion of the inactivated material, the material is activated by the heat and light to emit electromagnetic radiation at wavelengths that affect protein structures in human hair. The temperature of the columnar air flow may be low enough that, by itself, the heated air cannot activate the inactivated material. Likewise, the intensity of the light from the light sources (3) may be insufficient to activate the inactivated material by itself. Nevertheless, together, the heated air and light from the light sources, are able to activate the inactivated material. This is a real benefit over previous uses of heat alone, to activate an inactivated material. In the present invention, the temperature of the columnar air flow may be kept significantly lower, which means less thermal damage to hair.

Compositions of the present invention that are useful for hair reshaping or styling must satisfy certain criteria. For example, the compositions must be cosmetically acceptable and commercially viable. "Cosmetically acceptable" and commercially viable" or the like, usually imply that a composition is stable under typical conditions of manufacture, distribution and consumer use. By "stable", we mean that one or more characteristics of a personal care composition do not deteriorate to an unacceptable level within some minimum period of time after manufacture. Preferably, that minimum time is six months from manufacture, more preferably one year from manufacture, and most preferably more than two years from manufacture.

Compositions of the present invention must be efficacious when used in reasonable amounts. A composition is considered effective to permanently reshape human hair, only if the amount of composition applied to the hair is what a consumer would consider reasonable. For example, if a lotion composition reshapes the hair, but a gallon of the composition is required, then this is not an effective composition according to the present invention. A person skilled in the art of personal care hair products has a very good idea of what consumers would consider reasonable. The amount of a composition of the present invention required for one treatment depends on the type and amount of hair being treated and on the desired effect. However, experience suggests that preferably, about 5 ounces or less of a composition according to the present invention is effective to complete a treatment of a full head of hair; more preferably, about 2.0 ounces or less; most preferably, about 1.0 ounce or less. While these amounts are preferred for commercial and consumer reasons, the present invention also contemplates larger amounts, as the case may necessitate.

Within the guidelines, herein discussed, virtually any cosmetically acceptable or commercially viable composition, that is beneficial or benign to human hair, can serve as a base composition. Generally, one could say that the base composition should not absorb too much of the radiation emitted by the activated material or by the light sources (3), and the base composition should not interfere with activation or deactivation of the suitable material. With those restrictions, a composition according to the present invention may contain any ingredients that are known to provide a benefit to the hair, any ingredients required to render a stable product, and any ingredients that render the product more cosmetically acceptable or commercially viable. For example, polyvinylpyrrolidone-based film formers are common hair product ingredients. In compositions according to the present invention, these or other film formers may help to maintain the tension in the hair while the disulfide bond reorganization is occurring. However, no film former is needed nor is it be integral to achieving the permanent reshaping effects discussed herein.

Compositions according to the present invention may contain chemical perming agents as an adjunct to the non-chemical mechanism disclosed herein. Preferably, however, a composition according to the present invention has no chemical agent or reagent that reacts with disulfide bonds. Preferably, the only mechanism of disulfide bond cleavage is direct excitation by electromagnetic radiation supplied from the suitable material in the composition.

Compositions according to the present invention may advantageously contain hair coloring agents. Hair coloring reactions of the type well known in the art, and disulfide bond cleavage as described herein, may exhibit synergistic effects.

The composition may have virtually any form, even solid or semi-solid, provided the composition can be distributed throughout the section of hair being treated, and along its length, from root to tip.

The suitable material may be added to the base composition or added during the manufacture of the base composition in any manner that the circumstances may require or allow. Some suitable materials may be incorporated into the composition by simple mixing, others may require pretreatments. The composition may be a mixture, a suspension, emulsion, a solid, a liquid, an aerosol, a gel, or mousse, just to name a few. The composition may be in the form of shampoo or conditioner. The composition may be hydrous or substantially anhydrous. "Substantially anhydrous" means less than about 10% total water content.

Tourmalines are expected to be useful at concentrations as low as about 1%. Regarding upper limits, in general, there may practical upper limits to the concentration of suitable material. After all, only so many disulfide bonds need to be reorganized to achieve a particular hair style. However, the practical upper limit of any particular suitable material depends on many factors, not the least of which is how much product does a consumer apply, expecting to get a certain result. Thus, in a commercial product, trial and error or consumer use testing may be the best way to determine the concentration of the suitable material. An example of a controlled trial and error experiment might be, styling hair samples with a defined amount of compositions comprising increasing concentrations of a suitable material, and observing the concentration at which no additional benefit is derived. The defined amount should be based on market knowledge of how much product consumers are likely to use for the given amount and type of hair. Useful compositions will contain up to about 1% of one or more tourmalines, preferably up to about 2% of one or more tourmalines, and more preferably up to about 5% of one or more tourmalines. Tourmalines are expected to be useful at concentrations up to at least about 10% of the composition, but a diminishing returns effect may result thereafter, depending on the exact nature of the composition, the temperature, the amount of hair being styled, the amount of product applied, etc. Other, more efficient emitter materials (higher emissivity) may be useful at concentrations well below 1%, while less efficient materials (lower emissivity) may only be useful at higher concentrations; above about 5% for example, or even above about 10%, for example.

Table 1 is an example of a cosmetically acceptable, commercially viable, effective composition according to the present invention, containing 5% tourmaline.

TABLE 1

5% Red Tourmaline Cream

| Ingredients | Percent by weight of composition |
|---|---|
| purified water | 65.20 |
| Aristoflex ® AVC (Ammonium Acrylodimethyltaurate/VP Copolymer) | 1.00 |
| glycerine | 2.00 |
| phenoxyethanol | 0.70 |
| Polyvinylpyrrolidone (PVP) | 3.00 |
| ceteryl alcohol | 4.60 |
| PEG-100 stearate | 1.00 |
| cetyl alcohol | 2.00 |
| petrolatum | 3.00 |
| shea butter | 5.00 |
| polyquaternium-7 | 2.50 |
| red tourmaline | 5.00 |
| glycerin/water/sodium PCA/urea/trehalose/polyquaternium-51/sodium hyaluronate | 5.00 |

Temperature Measurements of Hair

The object of this study was to determine the effects of a fixed array of light sources (3), as described herein, and the effect of hot air from a handheld blow dryer, on the temperature of hair that has been treated with red tourmaline or black tourmaline.

A fixed arrays of lights sources, as shown in the figures (i.e. a solid ring) was prepared from polycarbonate plastic and 16 LEDs. The LEDs emit at a peak wavelength of 627 nm (i.e. visible red). Each of the 16 LEDs produce approximately 25 $mW/cm^2$ of light, with a total array power of 400 $mW/cm^2$. The center diameter of the plastic ring was about 2 in. and the ring was positioned over the barrel of a typical consumer hair blower. For these experiments rubber-based electrical tape was wrapped around the hair blower to prevent slippage of the ring. A Texpower HY1803D regulated supply was used to supply 2.2 volts to the LEDs, which were connected in series. The hair blower with light source array was affixed to a pole mount and aimed at swatches of hair mounted on a wire mesh screen. The purpose of the screen is to simulate real hair drying by allowing air circulation when the hair blower is on. Those hair samples that were treated with the light, were held at the convergence point of the LED array, in this case, about 4-5 cm from the exit orifice of the nozzle. A base cream containing black or red tourmaline was applied by hand, to samples of hair swatches. Untreated hair served as a control. Some samples were exposed to hot air from the blow dryer on the low heat setting. Some samples were exposed to light from the LED array. And some samples were exposed to hot air and light simultaneously. Fresh, or newly prepared hair swatches were used for each test.

To monitor the temperature response of the hair samples, an IR thermometer (Omega OS520) was affixed to a pole mount, and aimed at the hair swatch during each test. The device has a spectral response of only 8μ to 14μ, and must be calibrated based on the emissivity of the target surface in order to get a true temperature reading. In this case, a type K thermocouple was used to calibrate the IR thermometer for use on hair. Thermocouple temperature measurements are not wavelength dependent, and calibration of the IR thermometer is achieved by adjusting the emissivity setting of the IR thermometer until the IR thermometer and thermocouple give the same temperature readings. IR thermometer data are shown in the following table.

| Low Heat Only | | Light only | | Light + Low Heat | |
|---|---|---|---|---|---|
| Untreated hair | | | | | |
| Time (sec) | Temp° C. | Time (sec) | Temp° C. | Time (sec) | Temp° C. |
| 0 | 26 | 0 | 22 | 0 | 25 |
| 20 | 55 | 20 | 24 | 20 | 55 |
| 40 | 55 | 40 | 24 | 40 | 56 |
| 60 | 55 | 60 | 25 | 60 | 56 |
| 2% Black Tourmaline treated | | | | | |
| Time (sec) | Temp © | Time (sec) | Temp © | Time (sec) | Temp © |
| 0 | 21 | 0 | 22 | 0 | 21 |
| 20 | 43 | 20 | 22 | 20 | 40 |
| 40 | 46 | 40 | 22 | 40 | 42 |
| 60 | 47 | 60 | 21 | 60 | 43 |
| 2% Red Tourmaline treated | | | | | |
| Time (sec) | Temp © | Time (sec) | Temp © | Time (sec) | Temp © |
| 0 | 17-18 | 0 | 22 | 0 | 17 |
| 20 | 41 | 20 | 19 | 20 | 33 |
| 40 | 43 | 40 | 19 | 40 | 40 |
| 60 | 44 | 60 | 18 | 60 | 42 |

It can be seen from the data that when the hair is not pre-treated with a tourmaline containing composition, then the blow dryer increases the temperature of the hair, the light array increases the temperature of the hair, and the effects are additive. However, when the hair is pre-treated with a tourmaline containing composition, then the blow dryer increases hair temperature (although not as much as before) while the light array actually decreases hair temperature, and the effects are subtractive. This was unexpected.

In a related experiment, and wishing to validate what we were seeing with the IR thermometer, we also used the thermocouple to measure the temperature response of hair, untreated and treated with a 2% black tourmaline composition. Thermocouple temperature response is wavelength dependent, as is the temperature response of an IR thermometer. Type K thermocouples were embedded in hair swatches of both un-treated and treated hair. The hair was subjected to blow drying, with the blow dryer on the highest heat setting. Thermocouple data are shown in the following table.

| Thermocouple Measurement - High Heat Only | | |
|---|---|---|
| time (seconds) | Untreated hair ° C. | Hair treated with 2% Black Tourmaline cream ° C. |
| 0 | 25.1 | 23.6 |
| 20 | 77.1 | 41.3 |
| 40 | 77.2 | 46.1 |
| 60 | 77.1 | 48.5 |
| 80 | 77.0 | 51.0 |

The thermocouple data verify that the temperature increase of hair treated with the tourmaline composition is significantly less than the temperature increase of untreated hair.

Discussion

We hypothesize that when the tourmaline is not present, the heat and light energy supplied to the hair increases the temperature of the hair. However, when the tourmaline is present on the hair, at least some of the heat and light energy is absorbed by the tourmaline, followed by re-emission of energy in a broad wavelength range, some of which is absorbed by disulfide bonds or other protein structures in the hair. Thus, some of the supplied heat and light energy is absorbed by the hair in a way that does not increase the temperature of the hair. Furthermore, these experiments demonstrate that light (627 nm peak) plus heat from a blow dryer at the lowest setting, had a greater effect on energy transfer to the tourmaline than either heat or light treatment separately. This indicates that energy transfer to the tourmaline can be enhanced by light and heat acting together. This was unexpected.

If we consider that a high setting on the blower is normally used to dry or straighten hair which results in hair temperatures in excess of 85° C., then the difference in temperature from normal use of a hair dryer to use of a the hair with a light array system as described herein, is 40° C. or more. This is a very large reduction in the temperature of the hair being treated or styled. The combination of a tourmaline composition, low level heat and light of selected wavelength, results in permanent styling of human hair, at temperatures much lower than normally required, for example, at least 40° C. lower. Clearly, this is less damaging to the hair.

Methods

The present invention includes methods of using the device herein described, with compositions comprising inactivated tourmaline. One method includes:

- providing a composition comprising inactivated tourmaline, such as those disclosed in PCT/US10/24641;
- applying a portion of the composition to a swatch of hair;
- activating the portion of the composition to emit the photons by treating the swatch of hair with heat and visible light simultaneously; and
- allowing the photons to be directly absorbed by protein structures in hair.

Furthermore, the step of "activating the portion of the composition" may include heating the portion of the composition to no more than 60° C., preferably no more than 50° C. and more preferably no more than 40° C.

Furthermore, the step of "treating the swatch of hair with heat and light simultaneously" may comprises the step of providing a device that creates a columnar air flow and a concentrated light spot within the air flow, at a location where the air and light impinge a hair surface.

After the step of "applying a potion of the composition to a swatch of hair" more detailed methods may include the step of applying tension to the section of hair to assume a desired shape. After the step of "allowing the photons to be directly absorbed by protein structures in hair" more detailed methods may include: deactivating the portion of the composition; and releasing the applied tension. Methods of the invention may include those wherein the steps between and including applying tension and releasing tension are completed in less than about 30 minutes.

The portion of the composition applied to the hair swatch is preferably about 5 ounces or less, more preferably about 2 ounces or less, and most preferably about one ounce or less. The step of applying the composition includes distributing the composition throughout the section of hair being treated, and along its length, from root to tip. Methods may include washing the hair before or after treatment. Methods may include repeating application to the same section of hair or using an adjunct treatment on the same section of hair.

What we claim is:

1. A method of reshaping human hair comprising the steps of:

providing a topical hair-reshaping composition that is capable of emitting photons at an intensity and range of wavelengths that are effective to alter tertiary and or secondary protein structures in the hair;

applying a portion of the composition to a swatch of hair;

activating the portion of the composition to emit the photons by treating the swatch of hair with heat and visible light simultaneously by providing a device that creates a columnar air flow and a concentrated light spot within the air flow, at a location where the air and light impinge the portion of the composition; and allowing the photons to be directly absorbed by protein structures in hair.

2. The method of claim 1 wherein after the step of "applying a portion of the composition to a swatch of hair" the method further comprises the step of applying tension to the section of hair to assume a desired shape, and after the step of "allowing the photons to be directly absorbed by protein structures in hair" the method further comprises the steps of deactivating the portion of the composition, and releasing the applied tension.

3. The method of claim 2 wherein the steps between and including applying tension and releasing tension are completed in less than about 30 minutes.

4. The method of claim 1 wherein the portion of the composition is about 2 ounces or less.

5. The method of claim 1 wherein the step of activating the portion of the composition includes heating the portion of composition applied to the section of hair, to no more than 60° C.

* * * * *